US007134925B2

(12) United States Patent
Kinoshita

(10) Patent No.: US 7,134,925 B2
(45) Date of Patent: Nov. 14, 2006

(54) SMALL WATERCRAFT WITH STRUCTURE INHIBITING WATER FROM ENTERING ENGINE

(75) Inventor: Yoshimasa Kinoshita, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 10 days.

(21) Appl. No.: 10/796,767

(22) Filed: Mar. 9, 2004

(65) Prior Publication Data

US 2004/0180585 A1 Sep. 16, 2004

(30) Foreign Application Priority Data

Mar. 10, 2003 (JP) ..... 2003-063818

(51) Int. Cl.
*B63H 21/10* (2006.01)

(52) U.S. Cl. ..... 440/88 A

(58) Field of Classification Search ..... 440/88 A, 440/88 R

See application file for complete search history.

(56) References Cited

U.S. PATENT DOCUMENTS

| | | | | |
|---|---|---|---|---|
| 2,773,953 | A | 12/1956 | Lawick | |
| 3,701,093 | A | 10/1972 | Pick | |
| 3,807,343 | A | 4/1974 | Peebles | |
| 3,999,178 | A | 12/1976 | Hamilton | |
| 4,011,848 | A | 3/1977 | Coddington | |
| 4,050,396 | A | 9/1977 | Ridgeway | |
| 4,276,454 | A | 6/1981 | Zathan | |
| 4,341,178 | A | 7/1982 | Price | |
| 4,697,535 | A | 10/1987 | Wileman, III | |
| 4,743,213 | A | 5/1988 | Nishida | |
| 4,766,329 | A | 8/1988 | Santiago | |
| 4,871,996 | A | 10/1989 | Tsunamoto et al. | |
| 4,917,061 | A | 4/1990 | Nagakura | |
| 4,941,854 | A | 7/1990 | Takahashi et al. | |
| 5,033,428 | A | 7/1991 | Sasaki | |
| 5,144,300 | A | 9/1992 | Kanno | |
| 5,516,312 | A | 5/1996 | Reed | |
| 5,634,422 | A | 6/1997 | Kobayashi et al. | |
| 5,846,102 | A | 12/1998 | Nitta et al. | |
| 6,000,355 | A | 12/1999 | Hall | |
| 6,024,068 | A | 2/2000 | Nakase et al. | |
| 6,352,045 | B1 * | 3/2002 | Takashima | 114/55.5 |
| 6,419,531 | B1 | 7/2002 | Nanami et al. | |
| 6,447,351 | B1 | 9/2002 | Nanami | |
| 6,612,881 | B1 | 9/2003 | Kanno | |
| 6,648,702 | B1 | 11/2003 | Nanami et al. | |

FOREIGN PATENT DOCUMENTS

| | | |
|---|---|---|
| JP | 2000-335486 | 12/2000 |

* cited by examiner

*Primary Examiner*—Ed Swinehart
(74) *Attorney, Agent, or Firm*—Knobbe, Martens, Olson & Bear, LLP

(57) ABSTRACT

A personal watercraft includes a hull and an engine. The engine has an air intake system through which air is delivered to combustion chambers of the engine. An overturn switch detects overturn of the hull. A control device stops an operation of the engine based upon an output of the overturn switch. A throttle valve is disposed in the air intake system to be actuated by a throttle valve actuator. The control device controls the blocks the intake system based upon the output of the overturn switch to inhibit water from moving toward the combustion chambers. The control device allows the engine to be restarted during a preset period of time after stopping the engine operation.

1 Claim, 11 Drawing Sheets

SMALL WATERCRAFT WITH STRUCTURE INHIBITING WATER FROM ENTERING ENGINE

PRIORITY INFORMATION

The present application is based on and claims priority under 35 U.S.C. § 119 to Japanese Patent Application No. 2003-063818, filed Mar. 10, 2003, the entire contents of which is expressly incorporated by reference herein.

BACKGROUND OF THE INVENTIONS

1. Field of the Inventions

The present inventions relate generally to small watercraft with a device for inhibiting water from entering an engine, and more particularly to a small watercraft that has a device for inhibiting water from entering its engine when the watercraft overturns.

2. Description of Related Art

Relatively small watercraft such as, for example, personal watercraft have become popular in recent years. This type of watercraft is quite sporting in nature and carries one or more riders. An internal combustion engine typically powers a jet pump unit that propels the watercraft by discharging a stream of water rearwardly. A hull of the watercraft forms an engine compartment and a tunnel in the rear-most and underside of the watercraft. The engine lies within the engine compartment. The jet pump unit generally is placed within the tunnel and includes an impeller driven by the engine to discharge the water. Occasionally, such a watercraft will overturn.

The watercraft use one or more air ducts to supply air to a generally enclosed engine compartment. The air is drawn from within the engine compartment for combustion. Thus, when such a watercraft overturns, water can enter the engine compartment and the engine itself through an air intake system of the engine, which can disable or damage the engine.

To reduce the likelihood of such engine damage, an shut-off system has been used. The shut-off system can have an overturn sensor or switch. The overturn switch generally detects watercraft movement that is consistent with a watercraft that is overturning. When such movement is detected, the overturn switch outputs a signal that is used to shut-off the engine or to stop an operation of the engine. By stopping the engine operation, induction of water into the engine is much less likely during watercraft inversion.

Typical overturn switch designs generally are gravity-biased or centrifugal in nature. When the associated watercraft overturns, the switch's position relative to gravity may cause the switch to detect the overturn or the rapid movement of the switch may cause the switch to detect the overturn. However, some watercraft are designed for sporting operation and often are operated in manners that cause rapid directional changes, for example, during operation over rough water. Such activities can cause the typical overturn switches to falsely indicate an overturn leading to an undesirable and unnecessary engine stop.

Some watercraft control systems allow the engine to continue to operate for a preset period of time after the overturn switch has generated the signal. For example, U.S. Pat. No. 6,648,702 discloses such a watercraft.

SUMMARY OF THE INVENTIONS

Occasionally, in watercraft that include a control system that incorporates a delay between overturn detection and engine shut-off, water can enter the air intake system of the engine during the delay. If the engine is restarted with water in the intake system, the water can enter combustion chambers of the engine due to the negative pressure generated in the combustion chambers and damage the engine.

To address such a need, at least one embodiment involves a watercraft comprising a hull. An internal combustion engine is disposed in the hull. The engine has an air intake system through which air is delivered to a combustion chamber of the engine. A sensor is arranged to detect overturn of the hull. A control device is configured to stop an operation of the engine based upon an output of the sensor. A blocking device is arranged in the air intake system to inhibit water from moving toward the combustion chamber under control of the control device.

Another aspect of the present invention involves a watercraft comprising a hull. An internal combustion engine is disposed in the hull. The engine has an air intake system through which air is delivered to a combustion chamber of the engine. A sensor is arranged to detect overturn of the hull. A control device is configured to stop an operation of the engine based upon an output of the sensor. A blocking device is arranged in the air intake system to inhibit water from moving toward the combustion chamber when the engine is stopped.

A further aspect of the present invention involves a watercraft comprising a hull. An internal combustion engine is disposed in the hull. The engine has an air intake system through which air is delivered to a combustion chamber of the engine. The air intake system has a throttle valve that regulates an amount of the air. A sensor is arranged to detect overturn of the hull. A control device is configured to control the throttle valve to move to a substantially closed position based upon the output of the sensor.

In accordance with a further aspect of the present invention, a watercraft comprises a hull. An internal combustion engine is disposed in the hull. A sensor is arranged to detect overturn of the hull. Means are provided for stopping an operation of the engine based upon an output of the sensor. Means are provided for inhibiting water from moving toward the combustion chamber based upon the output of the sensor.

In accordance with a further aspect of the present invention, a method is provided for inhibiting water from entering a combustion chamber of an engine. The method comprises determining whether a watercraft hull overturns, stopping an operation of the engine if the watercraft hull overturns, and blocking water from moving toward the combustion chamber based upon the signal.

In accordance with a further aspect of the present invention, another method is provided for inhibiting water from entering a combustion chamber of an engine. The method comprises determining whether a watercraft hull overturns, stopping an operation of the engine if the watercraft hull overturns, and blocking water from moving toward a combustion chamber when the operation of the engine has been stopped.

In accordance with a further aspect of the present invention, a further method is provided for inhibiting water from entering a combustion chamber of an engine. The method comprises determining whether a watercraft hull overturns, and moving a throttle valve of the engine to a substantially closed position to block the water from moving toward a combustion chamber of the engine if the watercraft hull overturns.

BRIEF DESCRIPTION OF THE DRAWINGS

These and other features, aspects and advantages of the present inventions are described in detail below with reference to the accompanying drawings of preferred embodiments, which are intended to illustrate and not to limit the present inventions. The drawings comprise eleven figures, in which.

DETAILED DESCRIPTION OF THE PREFERRED EMBODIMENTS OF THE INVENTION

The present inventions generally relate to an improved shut-off system. The shut-off system is described in conjunction with a personal watercraft because this is an application in which the system has particular utility. Accordingly, an exemplary personal watercraft will first be described in general detail to assist the reader's understanding of the environment of use. Those of ordinary skill in the relevant art will readily appreciate that the shut-off system described herein can also have utility in a wide variety of other settings, for example, without limitation, small jet boats and the like.

Figure 1:
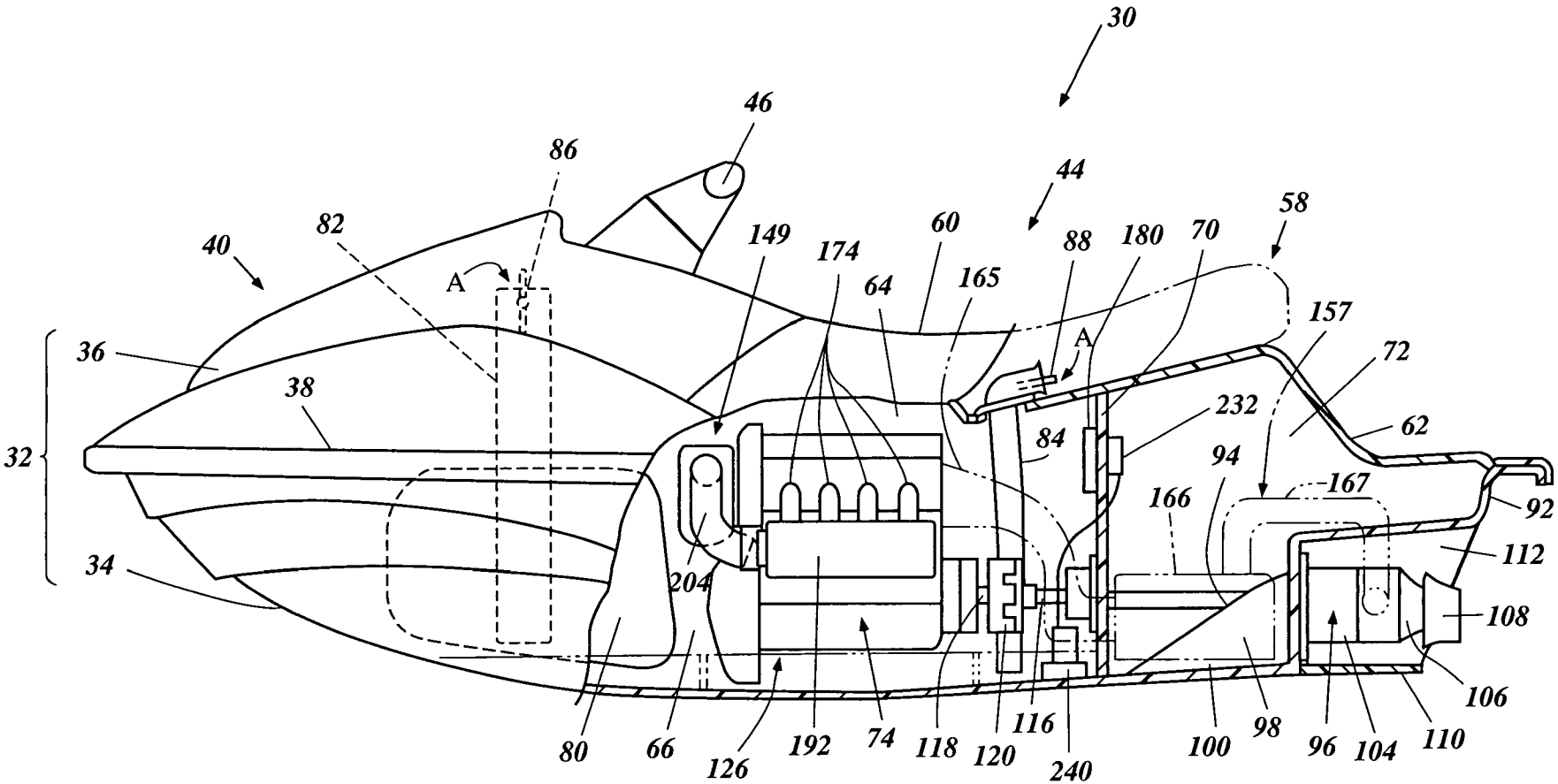
FIG. 1 is a side elevation view of a small watercraft with the rear portion of the watercraft shown in cross-section, certain internal components of the watercraft being illustrated with hidden lines.

With reference to FIG. 1, a personal watercraft 30 includes a hull 32 that includes a lower portion 34 and a top portion or deck 36. These portions of the hull 32 are preferably formed from a suitable material, such as, for example, a molded fiberglass reinforced resin. A bond flange 38 preferably connects the lower portion 34 to the deck 36. Of course, any other suitable means may be used to interconnect the lower portion 34 and the deck 36. Alternatively, the lower portion 34 and the deck 36 can be integrally formed.

As viewed in the direction from the bow to the stern, the deck 36 includes a bow portion 40, a control mast 42, and a rider's area 44. The bow portion 40 preferably includes a hatch cover (not shown). The hatch cover preferably is pivotally attached to the deck 36 such that the hutch cover is capable of being selectively locked in a substantially watertight position. A storage bin (not shown) preferably is positioned beneath the hatch cover.

Figure 8:
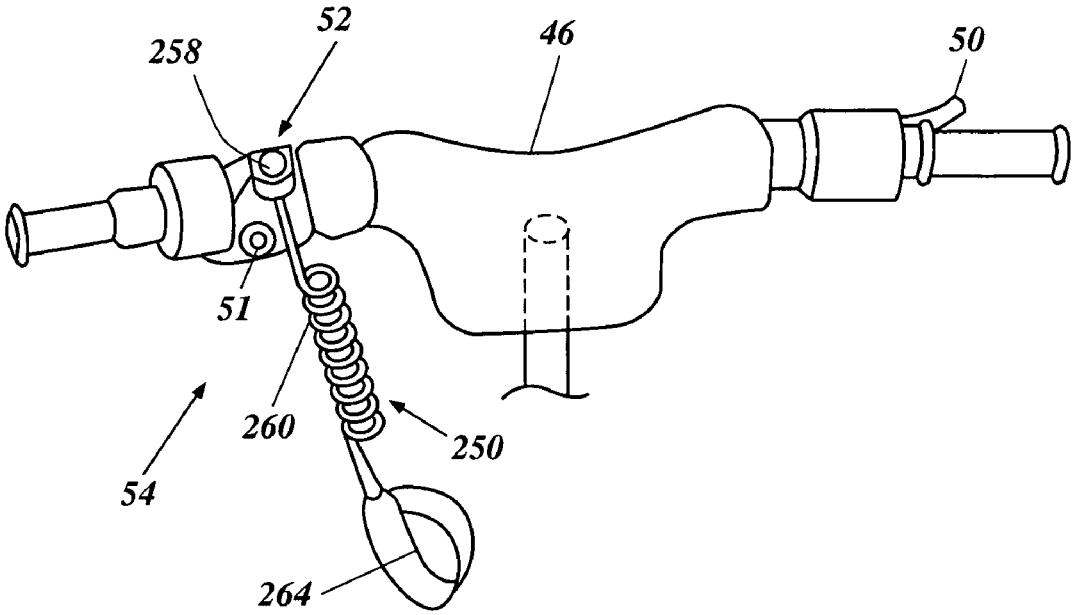
FIG. 8 is schematic illustration of a handle bar assembly of the watercraft including a lanyard switch assembly.
Figure 9:
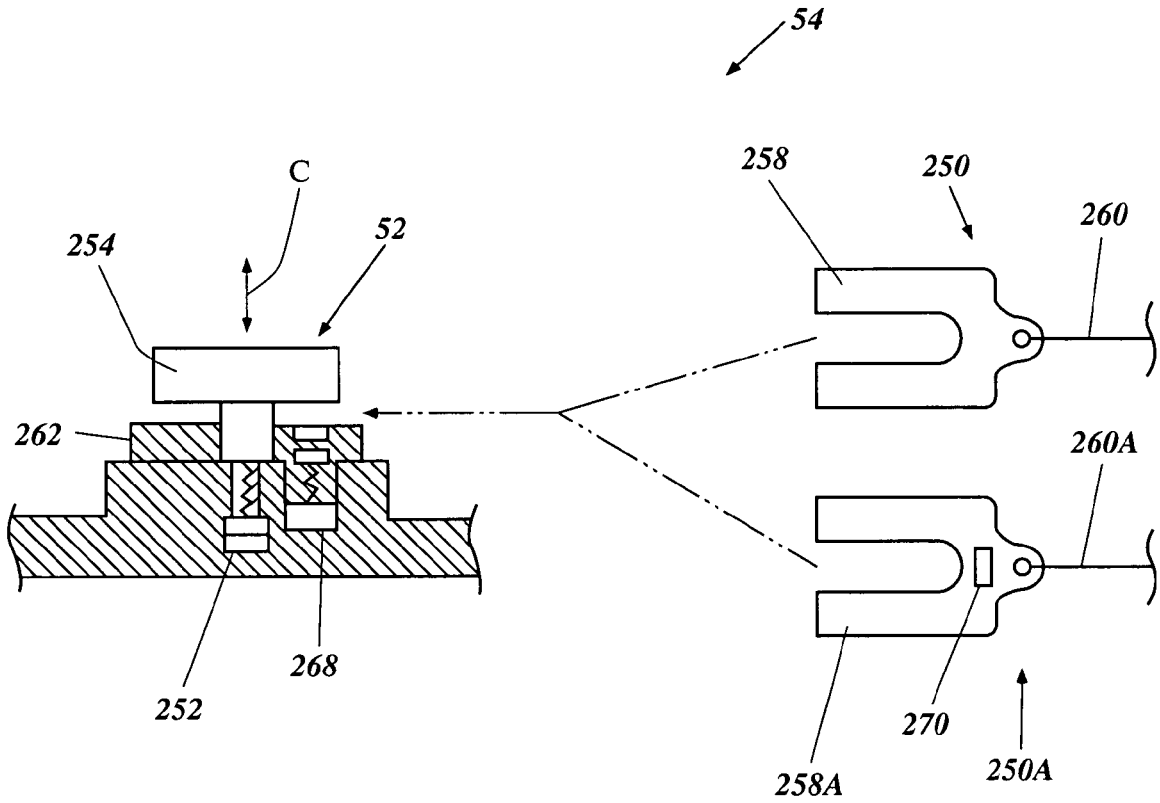
FIG. 9 is schematic illustration of the lanyard switch assembly.

The control mast 42 supports a handlebar assembly 46. The handlebar assembly 46 controls the steering of the watercraft 30 in a conventional manner. The handlebar assembly 46, as shown in FIG. 8, preferably carries a variety of controls for the watercraft 30, such as, for example, a throttle valve control lever 50, a start switch unit 51, and a stop switch unit 52, which is a part of a lanyard switch assembly 54. Additionally, a gauge assembly (not shown) is preferably mounted to the deck 36 forward of the control mast 30. The gauge assembly can include a variety of gauges, such as, for example, a fuel gauge, a speedometer, an oil pressure gauge, a tachometer, and a battery voltage gauge.

With continued reference to FIG. 1, the rider's area 44 lies rearward of the control mast 42 and includes a seat assembly 58. The illustrated seat assembly 58 includes at least one seat cushion 60 that is supported by a raised pedestal 62. The raised pedestal 62 forms a portion of the deck 36, and has an elongated shape that extends longitudinally substantially along the center of the watercraft 30. The seat cushion 60 preferably is detachably disposed over a top surface of the raised pedestal 62 by one or more latching mechanisms (not shown) and covers the entire upper end of the pedestal 62 for rider and passenger comfort.

An engine access opening 64 is located in the upper surface of the illustrated pedestal 62. The access opening 64 opens into an engine compartment 66 formed within the hull 32. The seat cushion 60 normally covers and substantially seals the access opening 64 to reduce the likelihood that water will enter the engine compartment 66. When the seat cushion 60 is removed, the engine compartment 66 is accessible through the access opening 64.

The interior of the hull 32 includes one or more bulkheads 70 that can be used to reinforce the hull 32 internally and that also can serve to define, in part, the engine compartment 66 and a propulsion compartment 72. The propulsion compartment 72 is arranged generally rearward from the engine compartment 66. An internal combustion engine 74 is mounted within the engine compartment 66 in any suitable manner preferably at a central transverse position of the watercraft 30. Preferably, a set of resilient engine mounts 76 (see FIG. 3) is used to connect the engine 74 to a set of stringers of the lower hull portion 34.

As shown in FIG. 1, a fuel tank 80 preferably is arranged in front of the engine 74 and is suitably secured to the hull 32 of the watercraft 30. A fuel filler tube (not shown) preferably extends between the fuel tank 80 and the deck 36, thus allowing the fuel tank 80 to be filled with fuel via the tube.

A forward air duct 82 extends to generally a bottom of the engine compartment 66 through the deck portion 36. The forward air duct 82 allows atmospheric air A to enter the engine compartment 66 through a water sealed structure (not shown). Similarly, a rear air duct 84 extends to the bottom of the engine compartment 66 through an upper surface of the seat pedestal 62, preferably beneath the seat cushion 60, thus also allowing atmospheric air A to enter and exit the engine compartment 66. A similar water seal structure is provided in the rear air duct 84. Air may pass through the air ducts 82, 84 in both directions (i.e., into and out of the engine compartment 66). Except for the air ducts 82, 84, the engine compartment 66 is substantially sealed so as to enclose the engine 74 of the watercraft 30 from the body of water in which the watercraft 30 is operated.

Both the forward and rear air ducts 82, 84 preferably include intake shut-off valves 86, 88. The shut-off valves 86, 88 can be made in a variety of ways but in the illustrated embodiment they comprise butterfly valves. Preferably, the shut-off valves 86, 88 are positioned in the forward and rear air ducts 82, 84 such that they lie above the engine compartment 66. The shut-off valves 86, 88 are connected to shut-off valve actuators 90 (see FIG. 6), which open and close the shut-off valves 86, 88. The shut-off vanes 86, 88 shut off the forward and rear air ducts 82, 84, respectively, while the actuators 90 are activated, to prevent water from entering the air ducts 82, 84 when the watercraft 30 overturns.

With continued reference to FIG. 1, toward the transom 92 of the watercraft 30, the lower hull portion 34 extends outwardly from a recessed channel or tunnel 94 that is recessed within the lower hull portion 34 in a direction that extends upward toward the upper deck portion 36. The tunnel 94 has a generally parallelepiped shape and opens through the transom 92 of the watercraft 30.

In the illustrated watercraft, a jet pump unit 96 propels the watercraft 30. The jet pump unit 96 is mounted within the tunnel 94 formed on the underside of the lower hull portion 34 by a plurality of bolts (not shown). An intake duct 98, defined by the hull tunnel 94, extends between the jet pump unit 96 and an inlet opening 100 that opens into a gullet of the intake duct 98. The intake duct 98 leads to an impeller housing 104.

A steering nozzle 108 is supported at the downstream end of a discharge nozzle 106 of the impeller housing 104 by a pair of vertically extending pivot pins (not shown). In an exemplary embodiment, the steering nozzle 108 has an integral lever on one side that is coupled to the handlebar assembly 46 through, for example, a Bowden-wire actuator, as known in the art. In this manner, the operator of the watercraft 30 can move the steering nozzle 108 to effect directional changes of the watercraft 30.

A ride plate 110 covers a portion of the tunnel 94 behind the inlet opening 100 to enclose the jet pump unit 96 within the tunnel 94. In this manner, the lower opening of the tunnel 94 is closed to provide a planing surface for the watercraft 30. A pump chamber 112 thus is at least partially defined within the tunnel section 94 covered by the ride plate 110.

An impeller shaft 116 supports an impeller (not shown) within the impeller housing 104. The aft end of the impeller shaft 116 is suitably supported and journaled within a compression chamber of the impeller housing 104 in a known manner. The impeller shaft 116 extends in a forward direction through the bulkhead 58. A protective casing preferably surrounds a portion of the impeller shaft 116 that lies forward of the intake duct 98. The forward end of the impeller shaft 116 is connected to an intermediate shaft 118 via a toothed coupling 120. The intermediate shaft 118 in turn is connected to a crankshaft 122 (see FIGS. 2 and 3) of the engine 74 through a reduction mechanism.

The engine 74, which drives the jet pump unit 96, is described below with initial reference to FIGS. 1–3. The illustrated engine 74 is a four-stroke, in-line, four-cylinder engine. However, it should be appreciated that several features and advantages of the present inventions can be achieved utilizing an engine with a different cylinder configuration (e.g., v-type, w-type or opposed), a different number of cylinders (e.g., six) and/or a different principle of operation (e g., two-cycle, rotary, or diesel principles).

The engine 74 comprises an engine body 126 having a cylinder head 128, a cylinder block 130 and a crankcase 132. The crankcase 132 defines a crankcase chamber 134. The cylinder block 130 preferably is formed with four generally vertically extending cylinder bores 136. The cylinder bores 136 may be formed from thin liners that are either cast or otherwise secured in place within the cylinder block 130. Alternatively, the cylinder bores 136 can be formed directly in the base material of the cylinder block 130. If a light alloy casting is employed for the cylinder block 130, such liners can be used.

A piston 138 is provided within each cylinder bore 136 and is supported for reciprocal movement therein. Piston pins connect the pistons 138 to respective connecting rods 140. The connecting rods 140, are journaled on the throws of the crankshaft 122. The crankshaft 122 is journaled by a plurality of bearings within the crankcase 132 to rotate about a crankshaft axis that lies generally parallel to the longitudinal axis of the watercraft 30. The crankshaft 122 thus rotates when the pistons 138 reciprocally move within the respective cylinder bores 136.

The cylinder head 128 is provided with individual recesses which cooperate with the respective cylinder bores 136 and the heads of the pistons 138 to form combustion chambers 142. These recesses are surrounded by a lower cylinder head surface that is generally planar and that is held in sealing engagement with the cylinder block 130, or with cylinder head gaskets (not shown) interposed therebetween, in a known manner. This planar surface of the cylinder head 128 may partially override the cylinder bores 136 to provide a squish area, if desired. The cylinder head 128 may be affixed to the cylinder block 130 in any suitable manner.

Poppet-type intake valves 146 are slidably supported in the cylinder head 128 in a known manner, and have their head portions engageable with valve seats so as to control the flow of the intake charge into the combustion chambers 142 through inner intake passages 148 formed in the cylinder head 128. In the illustrated arrangement, two intake valves 146 are provided per cylinder. The inner intake passages 148 define inner part of an air intake system 149 through which air is delivered to the combustion chambers 142. The intake valves 146 are biased toward their closed position by coil compression springs (not shown). The valves 146 are operated to their open position by an intake camshaft 150 which is suitably journaled in the cylinder head 128 in a known manner. The intake camshaft 150 has lobes that operate the intake valves 146 through thimble tappets.

Figure 2:
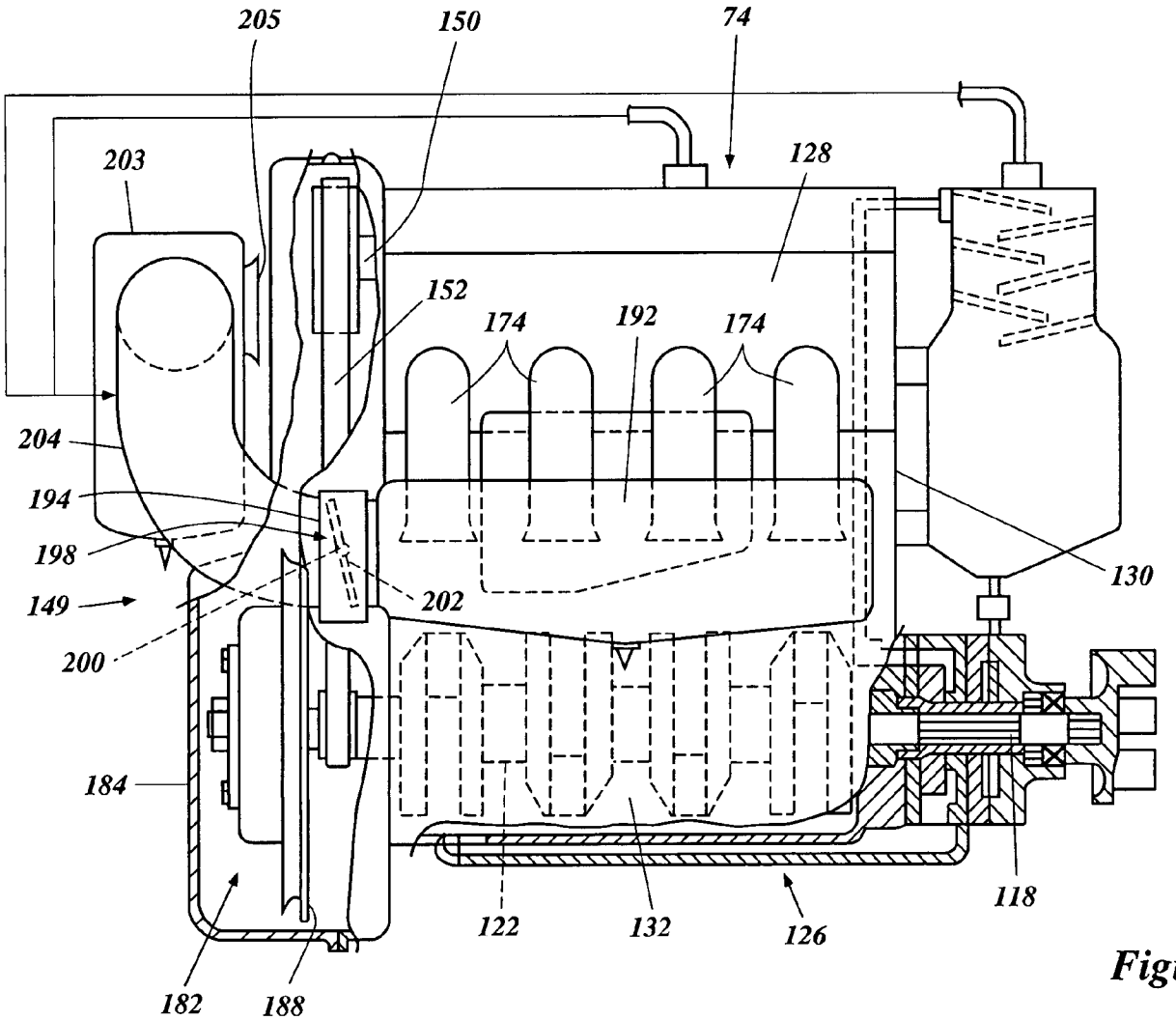
FIG. 2 is an enlarged left side view of the engine with front and lower portions of the engine shown in cross-section, certain internal components being illustrated with hidden lines.

The intake camshaft 150 is driven by the crankshaft 122 via a camshaft drive mechanism, which is partially shown in FIG. 2. In particular, the camshaft drive mechanism includes a timing belt 152 that couples the crankshaft 122 to the intake camshaft 150. The camshaft drive mechanism is well known in the art; thus, a further description of this mechanism is not necessary for one of ordinary skill in the art to practice the present invention.

Figure 3:
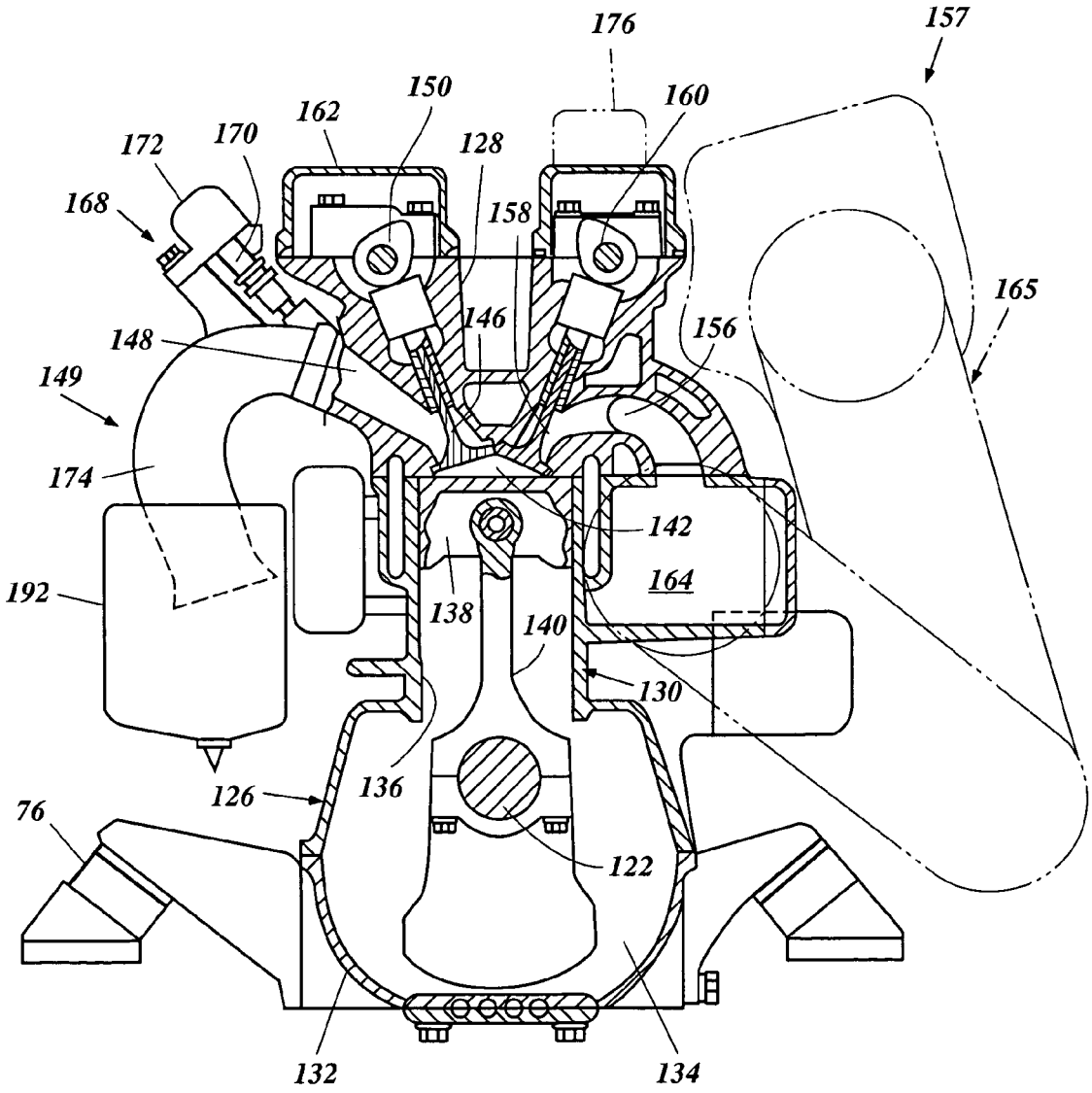
FIG. 3 is a rear cross-sectional view of an engine of the watercraft.

With particular reference to FIG. 3, the cylinder head 128 includes at least one inner exhaust passage 156 for each combustion chamber 142. The exhaust passages 156 emanate from one or more valve seats formed in the cylinder head 128. The exhaust passages 158 define an inner part of an exhaust system 157 that routes exhaust gases to an external location of the watercraft 30.

At least one poppet type exhaust valve 158 is supported for reciprocation in the cylinder head 128 for each combustion chamber 142, in a manner similar to the intake valves 146. In the illustrated arrangement, two exhaust valves 158 are provided per cylinder. The exhaust valves 158 also are biased toward their closed position by coiled compression springs (not shown).

An overhead mounted exhaust camshaft 160 opens and closes the exhaust valves 158. As with the intake camshaft 150, the exhaust camshaft 160 is suitably journaled for rotation in the cylinder head 128 and includes cam lobes that cooperate with thimble tappets for operating the exhaust valves 158 in a known manner. In the illustrated engine 74, the rotational axis of the intake camshaft 150 and the exhaust camshaft 160 are parallel to each other. Similar to the intake camshaft 150, the crankshaft 122 drives the exhaust camshaft 160 through the camshaft drive mechanism in a known manner.

A valve cover 162 encloses the camshafts 150, 160 and is sealably engaged with an upper surface of the cylinder head 128. As such, the valve cover 162 protects the camshafts 150, 160 from foreign material and entraps any lubricants provided to the camshafts 150, 160.

An exhaust manifold 164 collects the exhaust gases that leave the inner exhaust passages 156. The exhaust gases travel into an initial exhaust pipe 165, through a water trap or water lock 166, through a secondary exhaust pipe 167 and exit the watercraft 30 proximate the jet pump unit 96. The illustrated initial exhaust pipe 165 extends through the bulkhead 70. Also, the illustrated secondary exhaust pipe 167 opens to the pump chamber 112. The exhaust system 157 is conventional and is not described further accordingly.

A proper amount of fuel for combustion in each combustion chamber 142 is supplied through a fuel supply system. In the illustrated arrangement, a fuel injection system 168 is used to supply the proper amount of fuel as the fuel supply system. The fuel injection system 168 includes the fuel tank 80 at the most upstream position in the system 168. The fuel injection system 168 includes a fuel injector 170 that sprays the proper amount of fuel into each inner intake passage 148. The sprayed fuel is drawn into the associated combustion chamber 142 together with the air when the intake valve 146 is in the open position.

A fuel rail 172 is connected to the fuel injectors 170 and also forms a portion of fuel conduits that deliver the fuel in the fuel tank 80 to the fuel injectors 170. The fuelrail 172 can be affixed to intake pipes 174 that define outer intake passages connected to the inner intake passages 148.

The fuel injection system 168 also includes a vapor separator (not shown), a low pressure fuel pump 176, a high pressure fuel pump (not shown) and a pressure regulator (not shown) which are arranged between the fuel tank 80 and the fuel injectors 170. The vapor separator separates vapor from the fuel. The low pressure fuel pump 176 preferably is disposed on the valve cover 176 and is driven by the exhaust camshaft 160. The high pressure fuel pump preferably is driven by the camshaft 122 and develops higher pressure that is enough for the injectors 170 to spray fuel into the intake passages 148. The pressure regulator regulates the pressure.

An electronic control unit (ECU) 180 (FIG. 4) controls the injection of the fuel from the fuel injectors 170. The ECU 180 in the illustrated arrangement is mounted onto a surface of the bulkhead 70 that faces the engine compartment 66. The ECU 180 is described in greater detail below.

A suitable ignition system is provided for igniting an air and fuel mixture that is provided to each combustion chamber 142. The ignition system preferably includes spark plugs (not shown). Each spark plug exposes into each combustion chamber 142 and fires the air and fuel mixture also under control of the ECU 180. A pulsar-coil, which can be incorporated in a flywheel magneto (not shown), generates firing signals for the ignition system.

The ECU 180 preferably comprises a central processing unit (CPU), storage or memory devices, input ports, output ports and internal connections that couple the CPU, the storages, the input ports and the output ports with each other. The storages preferably comprise read only memories (ROM) and random access memories (RAM) and store various control programs, control maps and data. The CPU is the kernel of the ECU 180 and controls the fuel injection system 168, the ignition system and other systems using the control programs and the control maps stored in the storages and also output signals from sensors located outside of the ECU 180. The ECU 180 also can function as a timer by counting clock pulses of its own. The ECU 180, the other systems and the sensors are described in greater detail below.

A flywheel assembly 182, which preferably is located in front of the engine body 126, includes the flywheel magneto. The flywheel assembly 182 preferably is coupled to the crankshaft 122 so as to be driven by the crankshaft 122 The flywheel magneto generates electric power other than the pulser signals, and provides the power to batteries for use of electric components such as, for example, the ECU 180, the ignition system, a starter motor (not shown) and other electrically operable actuators. A cover 184 is attached to the front end of the cylinder block 130 and cylinder head 128 to enclose the flywheel assembly 182.

The starter motor preferably is disposed next to the flywheel assembly 182 and has a starter gear that meshes with a ring gear 188 of the flywheel assembly 182 via a one-way clutch. The one-way clutch couples the starter motor with the flywheel assembly 182 when the starter motor drives the flywheel assembly 182 and disconnects those components from each other when the engine 74 is started.

In order to start the engine 74, the operator operates the start switch unit 51 on the handle bar assembly 46. Power is supplied to the starter motor from the batteries and the starter motor drives the flywheel assembly 182 through the gear connection, i.e., the starter gear and the ring gear 188. Because the flywheel assembly 182 is coupled to the crankshaft 122, the crankshaft 122 is driven and then the engine 74 starts. Afterwards, the one-way clutch disconnects the starter motor from the flywheel assembly 182.

With continued reference to FIGS. 1–3, the intake pipes 174 of the intake system 149 extend generally downwardly from the cylinder head 128 and communicate with an intake chamber or plenum chamber 192, which can be positioned entirely lower than the cylinder head 128. The intake chamber 192 is positioned generally below the intake pipes 174 and along a side of the engine body 126.

A throttle body 194 can be located upstream of the intake chamber 192. A butterfly-type throttle valve 198 is journaled within the throttle body 194. As is typical with butterfly-type valves, the illustrated throttle valve 198 includes a valve shaft 200 and a valve disc 202. The throttle valve 198 regulates an amount of the air that is drawn to the combustion chambers 142.

An intake silencer 203 is positioned generally in front of the illustrated engine 74 to reduce intake noise. An intake duct 204 connects the intake silencer 203 to the throttle body 194. Preferably, the intake duct 204 extends downwardly and rearwardly from the intake silencer 203 to the throttle body 194. The intake silencer 203 has an inlet 205 that faces the engine body 126. The air in the engine compartment 66 thus is drawn into the silencer 203 and then is delivered to the combustion chambers 142 through the air intake system 149.

Figure 4:
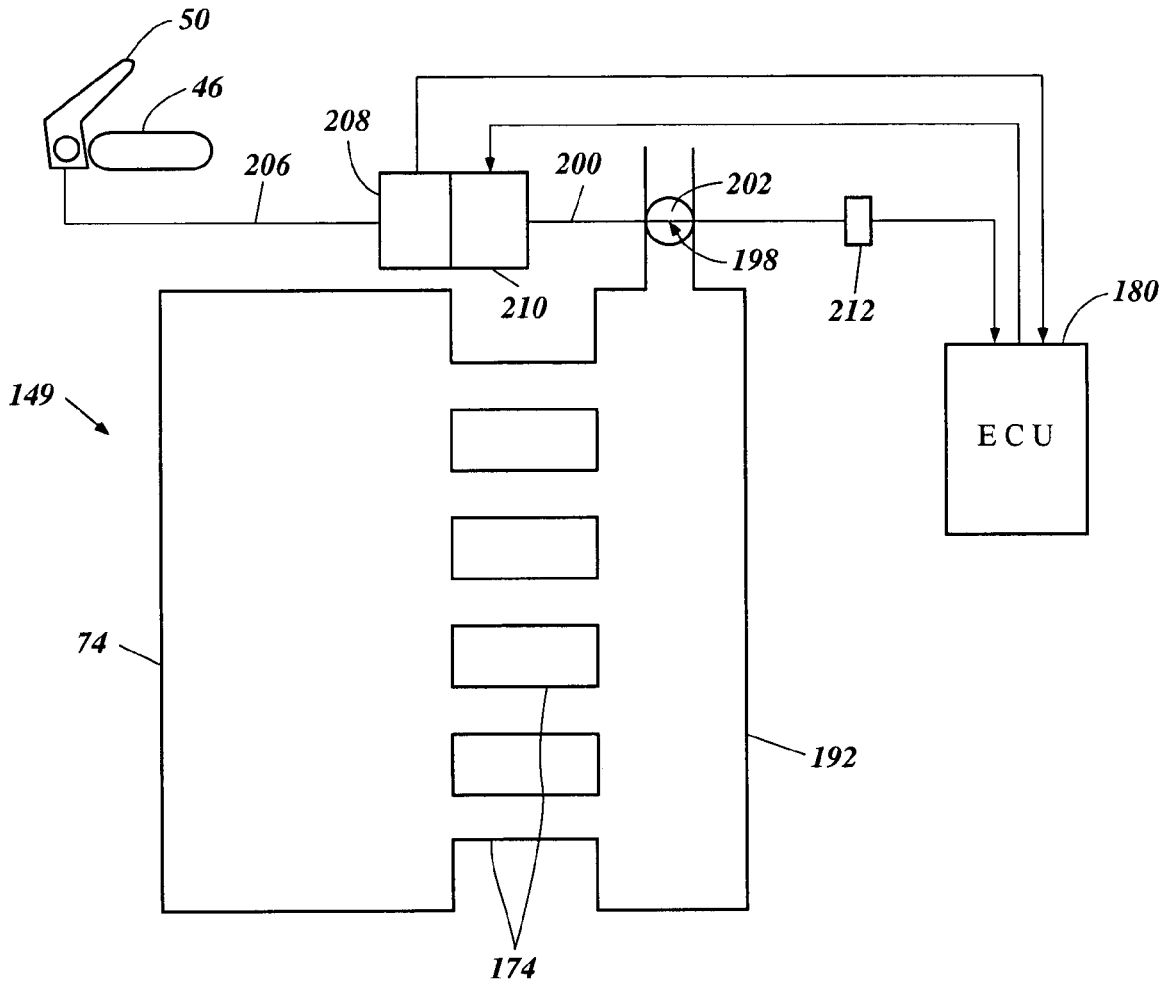
FIG. 4 is schematic illustration of a throttle valve control system.

With particular reference to FIG. 4, the throttle valve 198 preferably is controlled by a throttle valve control system, which includes the throttle valve control lever 50, a mechanical cable 206, a throttle valve position setter 208, the ECU 180, a throttle valve actuator 210 and a throttle valve position sensor 212. The position setter 208 and the position sensor 212 preferably are potentiometers. The mechanical cable 206 preferably comprises a Bowden-wire and mechanically connects the throttle valve control lever 50 to the position setter 208. The illustrated position setter 208 is disposed next to the actuator 210 and is preferably coupled with the actuator 210.

In one variation, the position setter 208 can be placed closer to the throttle valve control lever 50 rather than to the actuator 210. The throttle valve actuator 210 preferably is an electric motor or servo motor. Preferably, the actuator 210 is affixed to one end of the valve shaft 200, while the position sensor 212 is affixed to another end of the valve shaft 200.

The operator operates the throttle valve control lever 50 to a desired control position. The mechanical cable 206 mechanically transfers the control position of the control lever 50 to the position setter 208. The position setter 208 electrically sets a target position of the throttle valve 198 corresponding to the control position of the control lever 50 and outputs a command signal indicative of a target position to the ECU 180. The ECU 180 calculates a control amount based upon the command signal and a signal of the position sensor 212 that indicates a current position of the throttle valve 198. The ECU 180 then commands the actuator 210 to actuate the throttle valve 198 with the calculated control amount. The throttle valve 198 thus moves toward the target position. The ECU 180 continuously monitors the output signal of the position sensor 212. When the throttle valve 198 reaches the target position and the output signal of the position sensor 212 becomes consistent with the target position, the ECU 180 commands the actuator 210 to stop further actuation. The throttle valve 198 is set to the desired position, accordingly.

The throttle valve 198 preferably moves between a fully open position $\theta o$ and a fully closed position $\theta c$. The closer the valve disc 202 approaches the fully open position $\theta o$, the larger the amount of the air or airflow rate is. Unless the environmental circumstances change, an engine speed and power output of the engine 72 increases generally along with increases in the air amount or airflow rate.

When the operator detaches his or her hand from the throttle valve control lever 50, the throttle valve 198 returns to a mechanically held position $\theta m$, which is equal to an initial idle position $\theta i$, at which the throttle valve 198 slightly opens from the fully closed position $\theta c$. In the illustrated embodiment, the throttle valve 198 also returns to the mechanically held position $\theta m$ whenever the ECU 180 is deactivated. An air amount at the idle position $\theta i$ can keep the engine operation at idle. The idle position $\theta i$ can move from the initial position in a small range by controls of the ECU 180 such as, for example, an idle speed control.

Figure 5:
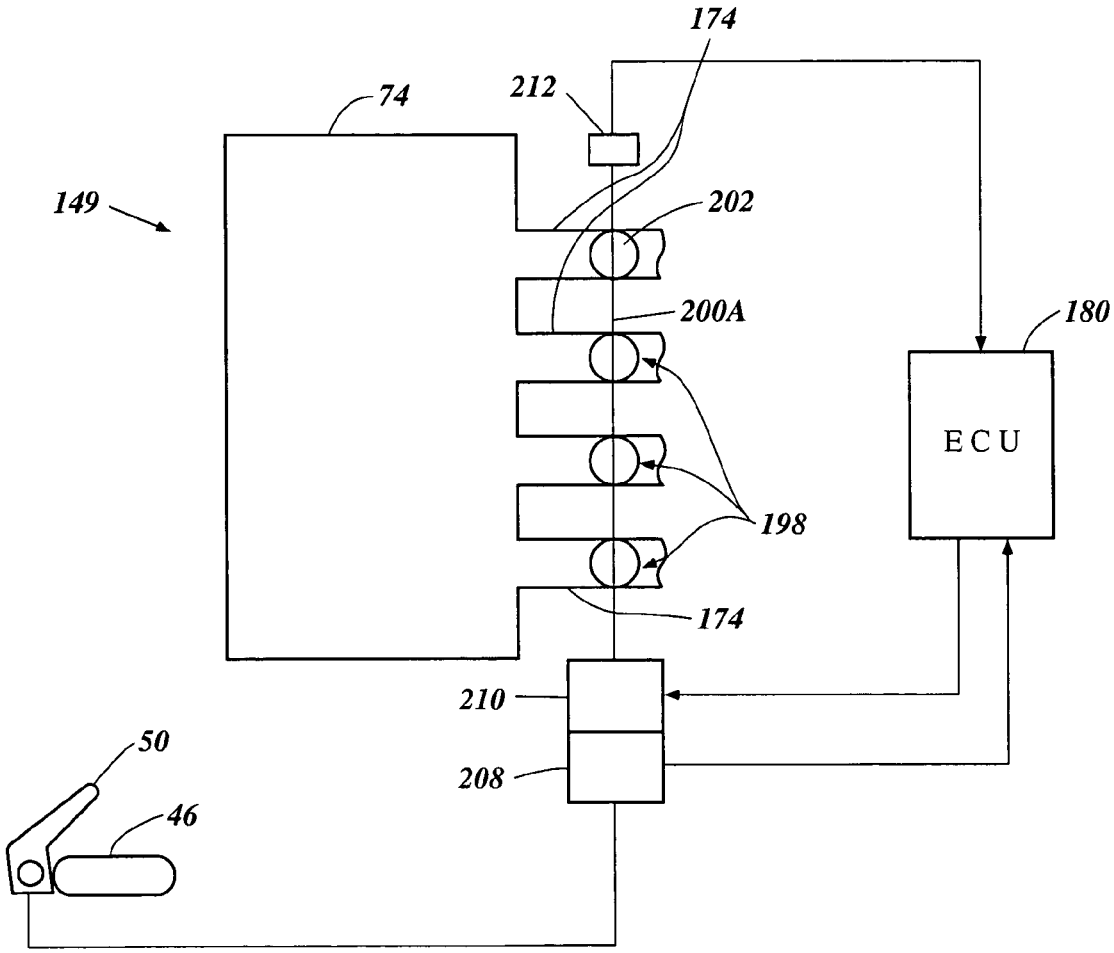
FIG. 5 is schematic illustration of an alternative throttle valve control system.

FIG. 5 illustrates an alternative arrangement of the throttle valve control system. In the alternative arrangement, one throttle valve 198 is positioned in each of the intake pipes 174. A valve shaft 200A supports all the valve discs 202 of the throttle valves 198. Other structures and controls are the same as the arrangement shown in FIG. 4.

Figure 6:
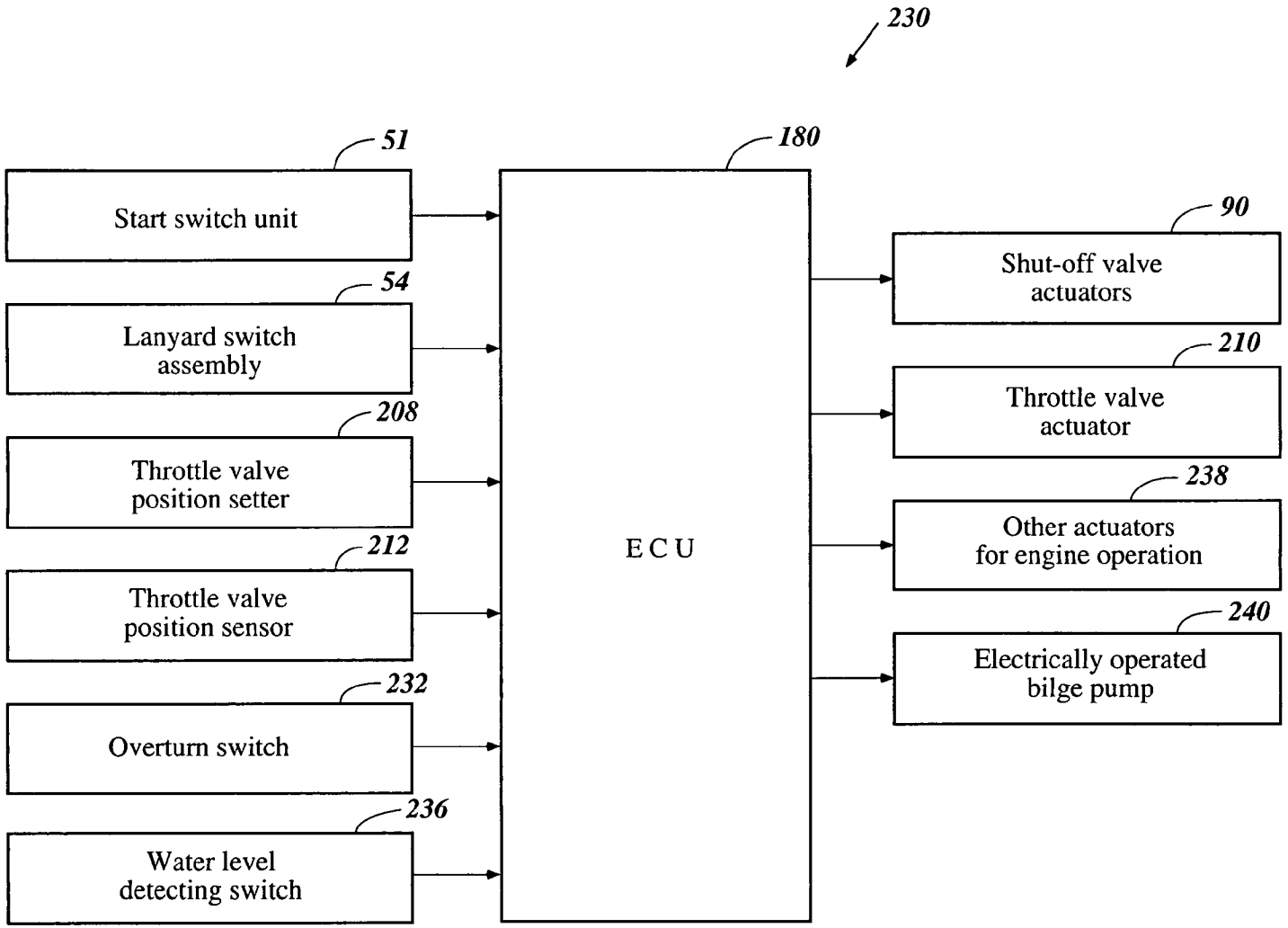
FIG. 6 is a block diagram showing a shut-off system that can be used in accordance with certain features, aspects, and advantages of at least one of the embodiments disclosed herein.
Figure 7:
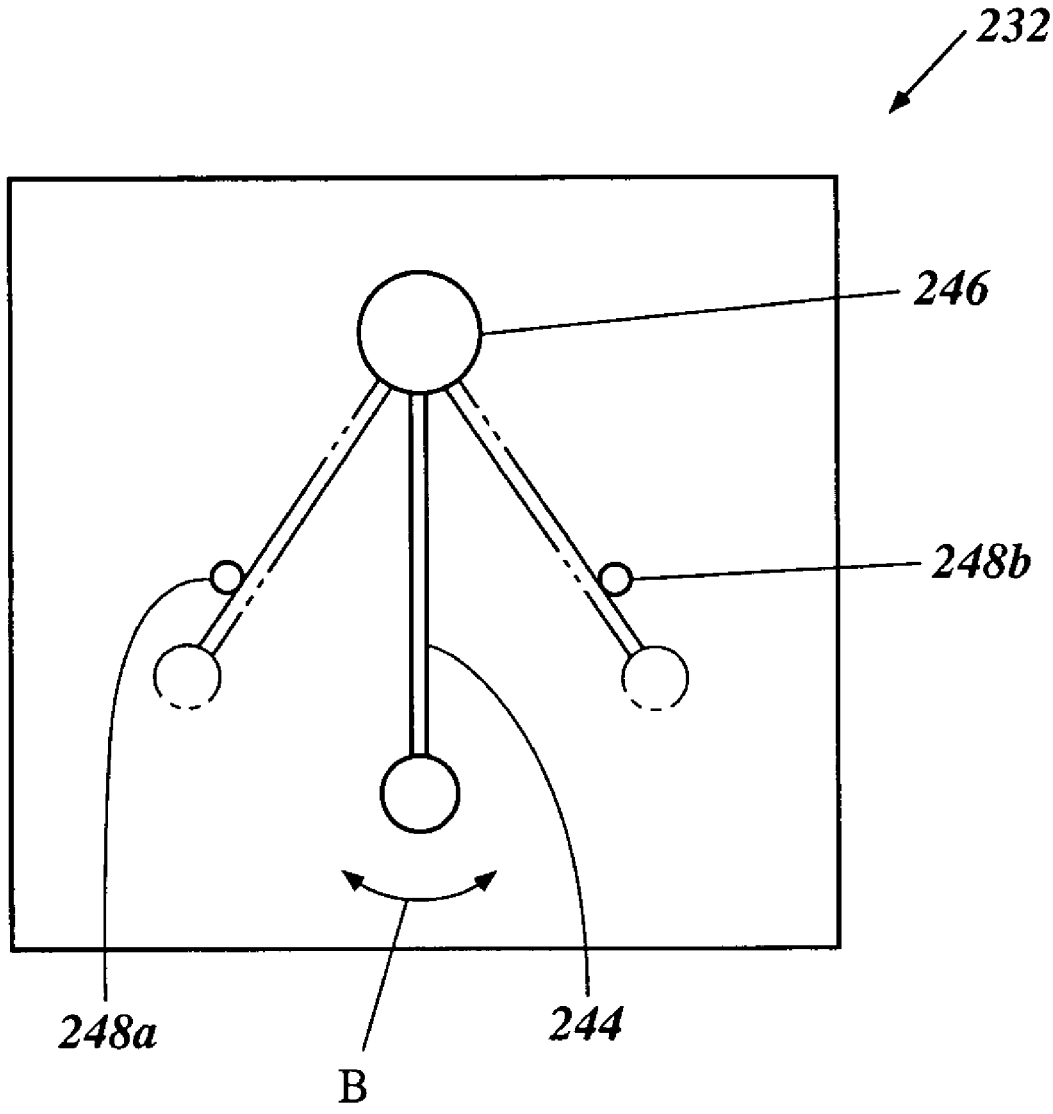
FIG. 7 is schematic illustration of an overturn switch.

With reference to FIGS. 6–8, a shut-off system 230 is described below.

The shut-off system 230 in the illustrated embodiment determines whether the watercraft 30 has overturned. If the determination is positive, the shut-off system 230 shuts off the engine 74, i.e., disables combustion in the engine 74 until the it stops. Additionally, the shut-off system 230 can optionally perform additional functions that prevent water from entering the engine compartment 66 through the air ducts 82, 84 and the engine 74 through the air intake system 149. The engine 74 preferably is prevented from being restarted for a preset period of time after the engine 74 is shut off. The illustrated shut-off system 230 also preferably performs a function to remove water accumulated in the engine compartment 66 to location external to the watercraft 30. Additionally, the illustrated shut-off system can trigger any combination of the functions noted above if the operator enters the water in which the watercraft 30 operates.

In order to perform the foregoing functions, the shut-off system 230 preferably comprises a control device, switches and/or sensors and actuators. The control device controls the actuators based upon outputs of the sensors. The control device in this embodiment is the ECU 180. The switches and/or sensors in this embodiment can include the start switch unit 51, the lanyard switch assembly 54, an overturn switch or overturn sensor 232, a water level detecting switch 236, the throttle valve position setter 208 and the throttle valve position sensor 212.

The actuators controlled by the ECU 180 preferably are various actuators 238 for the engine operation and can include the fuel injectors 70 and the spark plugs, the throttle valves actuator 210, the shut-off valve actuators 90, and an electrically operated bilge pump 240. The switches and/or sensors and the actuators in the illustrated embodiment are connected to the ECU 180 through electrical wires. Any other connecting members, couplings or devices such as, for example, photo-couplings and wireless devices can be used instead of the electrical wires.

Additionally, the illustrated watercraft 30 has a power switch (not shown) to supply electric power to electrical components of the watercraft 30 from the batteries. The power switch activates the electrical components including the ECU 180, the fuel injectors 170 and the spark plugs by allowing the electric power to be supplied to those components.

FIG. 7 illustrates an arrangement of the overturn switch 232. The overturn switch 232 includes a pendulum 244 that is configured to pivot about an axis 246. When the watercraft 30 is overturned, the pendulum 244 pivots, as indicated by the arrow B, and rests against the right or left stopper 248*a*, 248*b*. When the pendulum 244 contacts one of the stoppers 248*a*, 248*b*, the overturn switch 232 outputs a signal indicative of overturn of the watercraft 30 to the ECU 180. As shown in FIG. 1, the overturn switch 232 preferably is affixed to the bulkhead 70 facing the propulsion compartment 72.

When the overturn switch 232 outputs the overturn signal, the ECU 180 begins to stop the engine operation. For example, the ECU 180 can be configured to disable combustion in one or more of the combustion chambers 142 by disabling at least one of fuel delivery, air delivery, or spark. In one embodiment, the ECU 180 can stop air delivery to all of the combustion chambers 142 by closing the throttle valve 198. This provides a further advantage in that the air flow towards the combustion chambers 142 is quickly slowed or stopped, thereby reducing the likelihood that any water that may be present in the air intake system will be entrained into the air flow and enter the combustion chambers 142.

For example, the ECU 180 can be configured to activate the throttle valve actuator 210 and optionally, the shut-off valve actuators 90. The throttle valve actuator 210 can be configured to set the throttle valve 198 to the fully closed position θc or at least a shut-off position θt that is almost equal to the fully closed position θc and can sufficiently inhibit water from entering the intake chamber 192. The open degree of the shut-off position θt can be smaller than any one of the idle position θi, the mechanically held position θm, and the start position θs even though the throttle valve 198 remains partially open in the shut-off position θt. The shut-off valve actuators 90 also set the shut-off valves 86, 88 to the closed position.

The lanyard switch assembly 54 is another type of an overturn sensor of the hull 32. That is, the stop switch unit 52 of the lanyard switch assembly 54 is activated when the operator is separated from the hull 32, i.e., when the operator falls into the water while the hull overturns. The stop switch unit 52 preferably is assembled with a lanyard unit 250 to allow the engine 74 to be started when those are combined together and stops the engine 74 when those are separated from each other. The stop switch unit 52 also deactivates the ECU 180 unless the lanyard unit 250 is attached to the stop switch unit 52.

In the illustrated embodiment, the lanyard switch assembly 54 is used together with the overturn switch 232. In one variation, the shut-off system 230 can selectively have the overturn switch 232 and the lanyard switch assembly 54.

With particular reference to FIG. 8, the stop switch unit 52 comprises a contact section 252 including a fixed contact and a movable contact, which are schematically illustrated in FIG. 8. When the movable contact is connected to the fixed contact, the engine 74 is ready to start. When the movable contact is disconnected from the fixed contact, the power supply to electrical components of the engine 74 is shut off and the engine 74 cannot be started. The stop switch unit 52 preferably has a knob 254 that is movable in a direction indicated by the arrow C and is normally biased to an extending position, which is the contact position, for example, by spring force.

The lanyard unit 250 preferably comprises a forked member 258 and a lanyard or tether 260. The forked member 258 extends from one end of the lanyard 260 and acts as a spacer that is disposed in a space defined between a switch body 262 and the knob 254 so as to hold the movable contact in the contact position with the fixed contact. The other end of the lanyard 186 forms a closed circle portion 264 such that the operator or rider can put the circle portion on around his or her wrist or attach to a belt loop or the like. In the event the rider falls into the water, the forked member 258 is pulled to be out from the space and the movable contact is moved to the non-contact position. The engine operation accordingly stops.

Additionally, the switch body 262 in he illustrated embodiment has another switch mechanism 268 next to the contact assembly 252. The switch mechanism 268 can make the ECU 180 limit the engine operation within a range lower than a preset engine speed. The switch mechanism 268 preferably is a proximity switch that senses magnetism. The switch mechanism 268 can of course use other switch constructions such as, for example, but without limitation, a contact switch construction including a fixed contact and a movable contact.

Another or second lanyard unit 250A can also be provided. The second lanyard unit 250A has a lanyard 260A and a forked member 258A. The lanyard 260A has the same configuration as the lanyard 260 of the first lanyard assembly 54. The forked member 258A is similar to the forked member 258 of the first lanyard unit 250; however, the forked member 258A includes a magnet piece 270. If the second lanyard unit 250A replaces the first lanyard unit 250, the magnetic piece 270 of the forked member 258A can exist adjacent to the proximity switch mechanism 268 such that the ECU 180 is activated.

The rider can use either the first lanyard unit 250 or the second lanyard unit 250A at his or her own choice. If the rider selects the first lanyard unit 250, the engine operation is not limited and the engine 74 can have a full output. On the other hand, if the rider selects the second lanyard unit 250A, the ECU 180 can cap the engine output. For example, if the maximum output of the engine is 100 h.p. (engine speed 7,000 rpm), the ECU 180 can restrict the engine's output to 80 h.p. (engine speed 6,000–6,500 rpm). That is, the choice of the first lanyard unit 250 provides a normal control mode. The choice of the second lanyard unit 250A in turn provides an economical control mode because fuel consumption can be smaller.

The start switch unit 51 starts the engine 74 and preferably has a switch button that can be a push button. For instance, when the operator pushes the switch button of the start switch unit 51 and keeps the button pushed, the starter motor drives the crankshaft 122 of the engine 74. The engine 74 starts accordingly. The ECU 180 preferably activates the throttle valve actuator 210, when the start switch unit 51 is closed, to set the throttle valve 198 to a start position ?s which is closer to the fully closed position ?c than the mechanically held position ?m. That is, an open degree of the throttle valve 198 at the start position ?s is smaller than the mechanically held position ?m. Preferably, the start position ?s is the same as the initial idle position ?i.

The start switch unit 51 also outputs a start signal to the ECU 180 when the operator pushes the start switch 51. The ECU 180 thus activates the fuel injection system 168 and the ignition system. The ECU 180 can use the start signal to determine whether the operator desires to restart the engine 74. If, however, the ECU 180 itself is deactivated, the engine 74 cannot be restarted because the fuel injection system 168 and the ignition system do not work without control by the ECU 180.

The water level detecting switch 236 is configured to detect when water in the engine compartment 66 exceeds a predetermined level (e.g., when the water level exceeds a height of an impeller shaft of the jet pump unit 98). The water level sensor 236 preferably includes a cylindrical body (not shown) that preferably is mounted to a bottom portion of the bulkhead 70 or another bulkhead in the engine compartment 66. The cylindrical body includes openings that allow water that has accumulated in the engine compartment 66 to enter the cylindrical body.

A buoy is positioned in the cylindrical body and is freely movable in a vertical direction. A positional detection element, such as, for example, a magnetic force detection element or infrared detection element, can be configured to detect if the buoy has reached the predetermined water level.

When water is accumulated in the engine compartment 66, the buoy begins to rise in the cylindrical body. When the buoy reaches the level of the positional detection element, the element outputs a signal to the ECU 180. When such a signal is received by the ECU 180, the shut-off system 230 stops the operation of the engine 74.

The bilge pump 240 preferably is placed on the bottom of the lower hull portion 34 in the engine compartment 66. The bilge pump 240 preferably is configured to remove water from the hull 32 and preferably to deliver the water to a low pressure part of the jet pump unit 96 under control of the ECU 180. The ECU 180 preferably starts the bilge pump 240 when the water level sensor 236 detects that the water accumulates to the predetermined level, i.e., the buoy reaches the position of the detection element. Accordingly, water that accumulates in the hull 32 while the watercraft 30 is overturned can be removed.

Additionally, the water level switch 236 and the bilge pump 240 can always work whenever the water accumulated in the engine compartment 66 exceeds the preset level whether the watercraft 30 overturns or does not overturn.

The overturn sensor, the shut-off valve actuators, the water level detecting switch and the bilge pump are disclosed in, for example, U.S. Pat. No. 6,648,702, titled CONTROL SYSTEM FOR SMALL WATERCRAFT, the entire contents of which is hereby expressly incorporated by reference.

Figure 10:
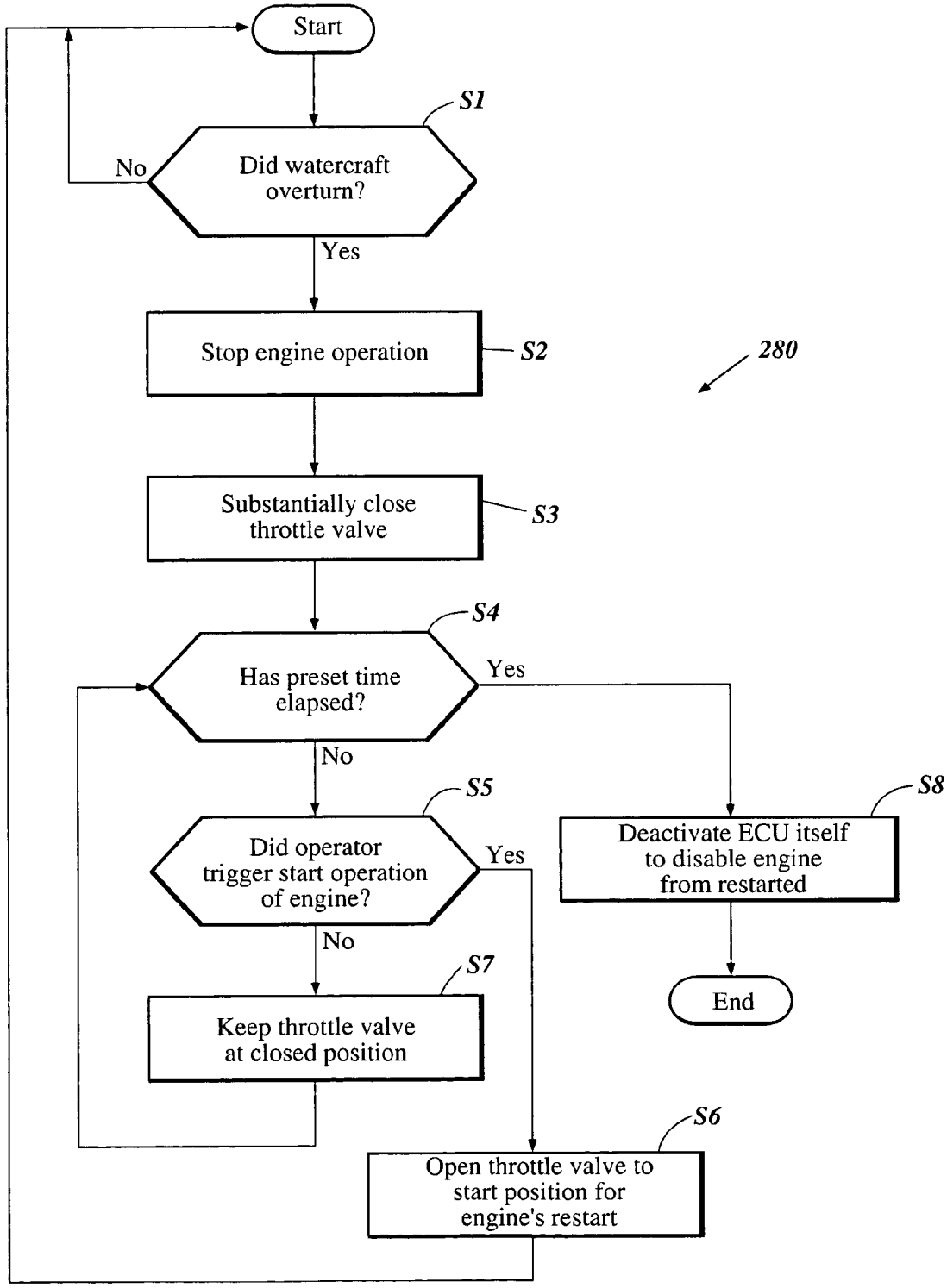
FIG. 10 is a flowchart showing an exemplary control program arranged and configured in accordance with certain features, aspects, and advantages of at least one of the embodiments disclosed herein.

With reference to FIG. 10, a control routine 280 which can be used with the shut-off system 230 is described below.

The illustrated control routine 280 preferably is stored in the storage of the ECU 180. The control routine 280 stops the engine operation upon determination of overturn of the watercraft 30. For example, but without limitation, the routine 280 can be configured to close throttle valve 198 to the fully closed position ?c or the shut-off position ?t, determine whether a preset time period Tp has elapsed, allow the engine to be restarted if the preset time period Tp has not elapsed, and deactivate the ECU 180 itself such that the engine 74 cannot be restarted if the preset time period Tp has elapsed.

To operate the watercraft 30, the operator can activate the power switch and attach the lanyard unit 250 to the stop switch unit 52. Then, the operator pushes the button of the start switch unit 51. The engine 74 is started and the watercraft 30 is ready to run. The operator drives the watercraft 30 in desired directions and in desired speeds by operating the handle bar assembly 46 and the throttle control lever 50.

When the start switch unit 51 is activated, the program 280 also starts and proceeds to a step S1. At a step S1, the ECU 180 preferably determines whether the watercraft 30 overturns. If the pendulum 244 of the overturn switch 232 abuts one of the stoppers 248*a*, 248*b*, the overturn switch 232 outputs an overturn signal to the ECU 180. The ECU 180 determines that the watercraft 30 overturns based upon the overturn signal and the determination thus is positive. On the other hand, if the pendulum 244 does not contact either of the stoppers 248*a*, 248*b*, the overturn switch 232 does not output the overturn signal to the ECU 180. The ECU 180 determines that the watercraft 30 is in the normal position and the determination is negative. If the determination at the step S1 is negative, the program 280 repeats the step S1 until the determination becomes positive. If the determination at the step S1 is positive, the program 280 goes to a step S2. Optionally, the overturn of the watercraft 30 can also be determined by the output of the lanyard switch assembly 54 indicating that the operator falls into the water.

The ECU 180, at the step S2, stops the operation of the engine 74. For example, but without limitation, the ECU 180 can disable the engine 74 from further operating by, for example, discontinuing delivering fuel to one, a plurality , or all the fuel injectors 170 in the fuel injection system and/or discontinuing firing of one, a plurality, or all of the spark plugs in the ignition system. In an alternative, a physical switch can be provided to prevent the power supply to the fuel injection system 168 and/or the ignition system and the ECU 180 can activate the physical switch at the step S2. Because of the quick stop of the engine 74, the negative pressure is inhibited from occurring in the combustion chambers 142. The air intake system 149 hardly has a chance to draw water thereinto, accordingly. The program 280 then goes to a step S3.

At the step S3, the ECU 180 controls the throttle valve actuator 210 to move the throttle valve 198 to the fully closed position ?c or at least the shut-off position ?t, which is closer to the fully closed position ?c and has the open degree that is exceedingly smaller than any one of the open degrees of the start position ?s, the mechanically held position ?m and the idle position ?i. Because of this shut-off action of the throttle valve 198, water, if any, existing in the intake system 149 upstream of the throttle valve 198 or entering the intake system 149 cannot move beyond the throttle valve 198 toward the intake chamber 192 and the engine 74. Thus, the throttle valve 198 in the illustrated embodiment acts as a water blocking device. Additionally, there is a reduced chance that water will be drawn into the intake system 149 because the engine 74 has been immediately stopped and no negative pressure is generated in the combustion chambers 142.

In one variation, the air intake system 149 can have a special water blocking device such as, for example, a shut-off valve which differs from the throttle valve 198 and normally is fully open and is fully or substantially closed by the ECU 180 when the ECU 180 determines that the watercraft 30 overturns.

As such, the ECU 180 can control the shut-off valve actuator at the step S3 to move the shut-off valves 86, 88 to the fully closed position thereof, alone or in combination with the control of the throttle valve described above. Water thus is prevented form entering the engine compartment 66. The program 280 goes to a step S4, afterwards.

The ECU 180, at the step S4, determines whether the preset period of time Tp has elapsed after the ECU 180 executed the engine stop at the step S2. The time Tp preferably is 30 seconds, although any period of time can be set as the time Tp. In some alternatives, counting of the time Tp can start immediately after the ECU 180 determines the overturn of the watercraft 30 at the step S1.

If the determination at the step S4 is negative, the program 280 goes to a step S5. At the step S5, the ECU 180 determines whether the operator has triggered a start operation of the engine 74. For example, the ECU 180 can determine whether the start switch unit 51 is operated. If the determination at the step S5 is positive, the program 280 goes to a step S6.

The ECU 180, at the step S6, reactivates the fuel injection system to deliver fuel to the fuel injectors 170 and/or reactivates the ignition system to fire the spark plugs. Also, at the step S6, the ECU 180 controls the throttle valve actuator 210 to move the throttle valve 198 to the start position ?s. The starter motor drives the crankshaft 122 upon the start switch unit 51 activated. The engine 74 thus is restarted. Afterwards, the program 280 returns back to the step S1.

If the determination at the step S5 is negative, the program 280 goes to a step S7. The ECU 180 continuously controls the throttle valve actuator 210 to keep the throttle valve 198 at the fully closed position ?c or the shut-off position ?t. The program 280 then returns to the step S4.

If the determination at the step S4 is positive, i.e., the time Tp has elapsed, the program 280 goes to a step S8. The ECU 180 disables the engine 74 from being restarted at the step S8. In the illustrated embodiment, the ECU 180 deactivates the ECU 180 itself to disable the engine 180 by, for example, discontinuing supplying electric power to the ECU 180. When the ECU 180 itself is deactivated, the throttle valve 168 returns to the mechanically held position ?m. The program 280 then ends.

In some alternatives, the ECU 180 can disable the engine 74 from restarted using manners other than disabling the ECU 180 itself. For example, the ECU 180 can invalidate the start signal of the start switch unit 51. In this alternative, the ECU 180 can still keep the throttle valve at the fully closed position ?c or the shut-off position ?t.

The operator recognizes that the engine 74 cannot be restarted due to water accumulating in the engine compartment 66 or water entering the intake system 149. The operator thus lands the watercraft 30 to remove the water. The operator only can start the engine after removing the water. In order to restart the engine 74, the operator preferably initializes the ECU 180 by, for example operating an initializing switch disposed on the ECU 180. The ECU 180 thus can be activated when the power switch is closed.

As thus discussed, the shut-off system 230 in the illustrated embodiment stops the engine operation and also shuts off the intake system 149 without delay. Water is surely inhibited from entering the engine 74 through the intake system 149 when the watercraft 30 overturns.

The throttle valve 198 is used to shut off the intake system 149. The illustrated shut-off system 230 thus is simpler than other systems using a special blocking device.

The shut-off system 198 allows the operator to restart the engine 74 within the preset period of time Tp. Thus, even though the engine 74 is falsely stopped due to a sensitive action of the overturn switch 232, a quick return of the engine operation is assured This is also true when the lanyard switch assembly 54 is activated by the operator separated from the hull 32 without the hull 32 itself overturning. That is, the shut-off system 198 allows the operator to restart the engine 74 by resetting the lanyard switch assembly 54 to the initial position during the preset time period Tp.

Because, in the illustrated embodiment, the engine 74 cannot be restarted without removing water after the preset time period Tp has elapsed, damage by the water in the intake system 149 is better avoided.

Figure 11:
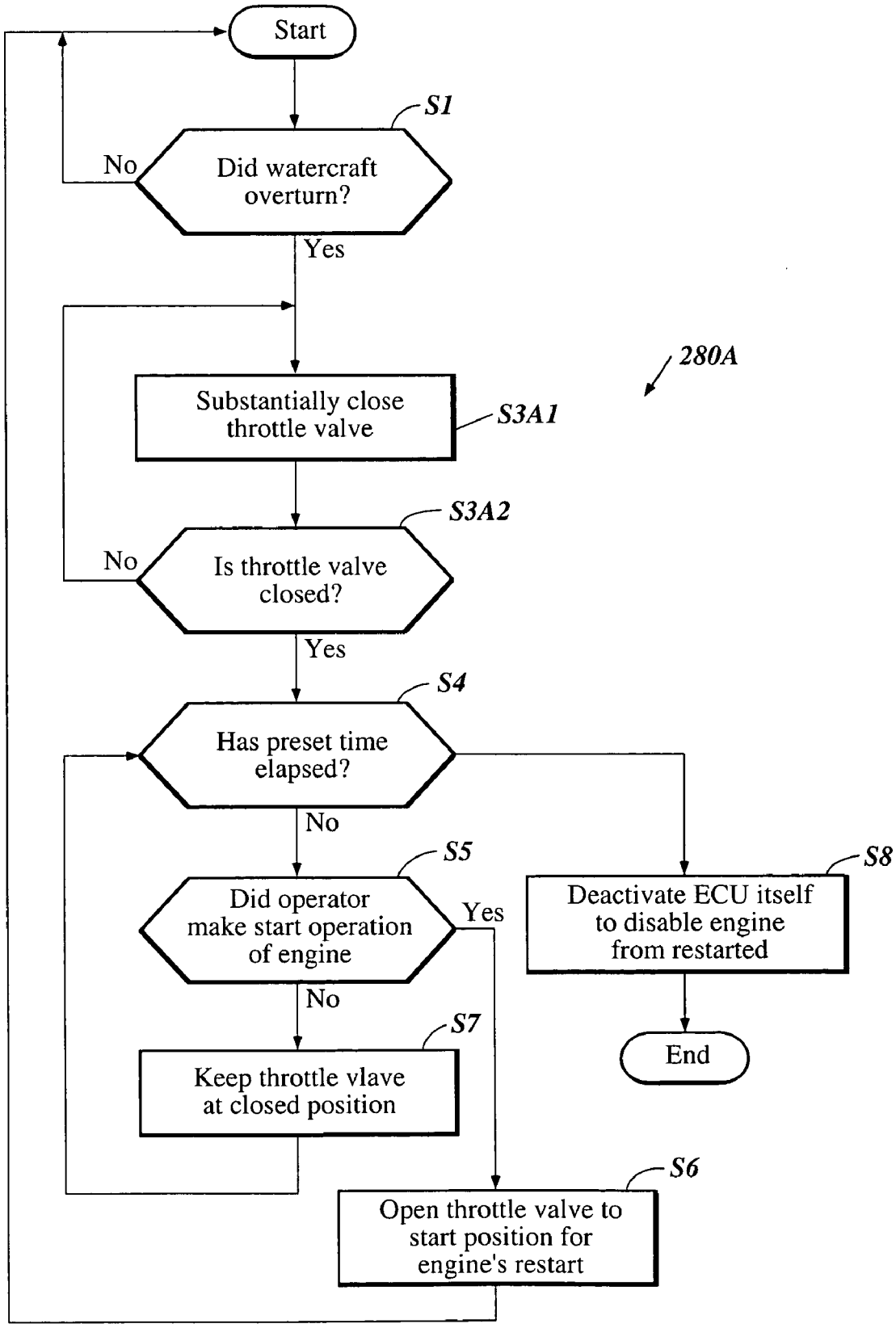
FIG. 11 is a flowchart showing a modified control program arranged and configured in accordance with certain features, aspects; and advantages of at least one of the embodiments disclosed herein.

With reference to FIG. 11, a modified control routine 280A of the shut-off system 230 is described below. The modified control routine 280A also can be stored in the storage of the ECU 180.

The control routine 280A can comprise the same steps as the control routine 280 except that in the control routine 280A, combustion in the engine 74 is stopped by choking the engine 74 instead of disabling the fuel injection system 168 and/or the ignition system. Thus, the same steps described above are assigned with the same reference numerals and are not described repeatedly. That is, the steps S1 and S4-S9 of the program 280 are also used in this program 280A. Steps S3A1 and S3A2 are newly added, although those are substantially identical to the step S3 of the program 280.

In the program 280A, if the determination at the step S1 is positive, i.e., the ECU 180 determines that the overturn switch 232 detects overturn of the watercraft 30, the program 280A goes to the step S3A1.

The ECU 180, at the step S3A1, controls the throttle valve actuator 210 to move the throttle valve 198 to the fully closed position ?c or at least the shut-off position ?t. Then, the program 280A goes to the step S3A2 and the ECU 180 determines if the throttle valve 198 has reached the fully closed position ?c or the shut-off position ?t, which had been preset. If the determination is negative, the program 280A returns to the step S3A1 to repeat the step S3A1. If the determination is positive, the program 280A goes to the step S4 to execute the step S4. It should be noted that the step S3 of the program 280 is divided into the steps S3A1 and S3A2 in this program 280A. In other words, the step S3A1 and the step S3A2 can be combined to make the step S3.

Additionally, the ECU 180 also controls the shut-off valve actuator at the steps S3A1 and S3A2.

The embodiment conducted by the modified program 280A is simpler because a separate step to stop the engine 74 such as, for example, disabling the fuel injection system 168 and/or the ignition system is not necessary.

There can be various ways to detect overturn of the watercraft 30 other than the overturn switch 232 and the lanyard switch assembly 54. For example, a sensor detecting a stress of the engine mount 76 that appears when the engine 74 is upside down can be an overturn sensor.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In some arrangements, both routines described above are integrated and implemented in a single application. Moreover, not all of the features, aspects and advantages are necessarily required to practice the present invention. Accordingly, the scope of the present invention is intended to be defined only by the claims that follow.

What is claimed is:

1. A watercraft comprising a hull, an engine compartment defined by the hull, an internal combustion engine disposed in the hull, the engine having an air intake system through which air is delivered from the engine compartment to a combustion chamber of the engine, a sensor arranged to detect overturn of the hull, a control device configured to stop an operation of the engine based upon an output of the sensor, and a throttle valve arranged in the air intake system, the control device configured to adjust the throttle valve through a range of openings to maintain idle speed operation of the engine, the control device being further configured to close the throttle valve beyond the range of positions used for idle speed operation, to inhibit water from moving through the intake system toward the combustion chamber in response to output from the overturn sensor.

* * * * *

UNITED STATES PATENT AND TRADEMARK OFFICE

CERTIFICATE OF CORRECTION

PATENT NO. : 7,134,925 B2
APPLICATION NO. : 10/796767
DATED : November 14, 2006
INVENTOR(S) : Kinoshita et al.

It is certified that error appears in the above-identified patent and that said Letters Patent is hereby corrected as shown below:

At column 3, line 38, please delete “aspects;” and insert -- aspects, --, therefor.

At column 5, line 12, please delete “vanes” and insert -- valves --, therefor.

At column 5, line 67, please delete “(e g.,” and insert -- (e.g., --, therefor.

Signed and Sealed this

Twenty-sixth Day of August, 2008

JON W. DUDAS
*Director of the United States Patent and Trademark Office*